US007885386B2

(12) United States Patent
Sundaram

(10) Patent No.: US 7,885,386 B2
(45) Date of Patent: Feb. 8, 2011

(54) SYSTEMS AND APPARATUS FOR A COMPACT LOW POWER X-RAY GENERATOR

(75) Inventor: Senthil Kumar Sundaram, Sanpada (IN)

(73) Assignee: General Electric Company, Schenectady, NY (US)

( * ) Notice: Subject to any disclaimer, the term of this patent is extended or adjusted under 35 U.S.C. 154(b) by 621 days.

(21) Appl. No.: 11/278,404

(22) Filed: Mar. 31, 2006

(65) Prior Publication Data

US 2007/0237298 A1 Oct. 11, 2007

(51) Int. Cl.
*H01J 35/12* (2006.01)

(52) U.S. Cl. ..... 378/142; 378/111

(58) Field of Classification Search ..... 378/119, 378/121, 126, 143, 140, 136, 101–113, 203, 378/142

See application file for complete search history.

(56) References Cited

U.S. PATENT DOCUMENTS

| | | | | |
|---|---|---|---|---|
| 3,467,849 | A * | 9/1969 | Wilson | 363/61 |
| 5,303,283 | A * | 4/1994 | Jedlitschka et al. | 378/202 |
| 5,528,652 | A * | 6/1996 | Smith et al. | 378/65 |
| 6,333,968 | B1 * | 12/2001 | Whitlock et al. | 378/136 |
| 2004/0109536 | A1 * | 6/2004 | Shefer et al. | 378/109 |

* cited by examiner

*Primary Examiner*—Hoon Song
(74) *Attorney, Agent, or Firm*—William Baxter, Esq.; Michael G. Smith, Esq.; Steven Stepanishen, Esq.

(57) ABSTRACT

Systems and apparatus are provided through which in some embodiments a compact X-ray generator having a cylindrical shape has a power supply located directly behind the cathode and/or anode inputs to the X-ray tube in some embodiments.

20 Claims, 7 Drawing Sheets

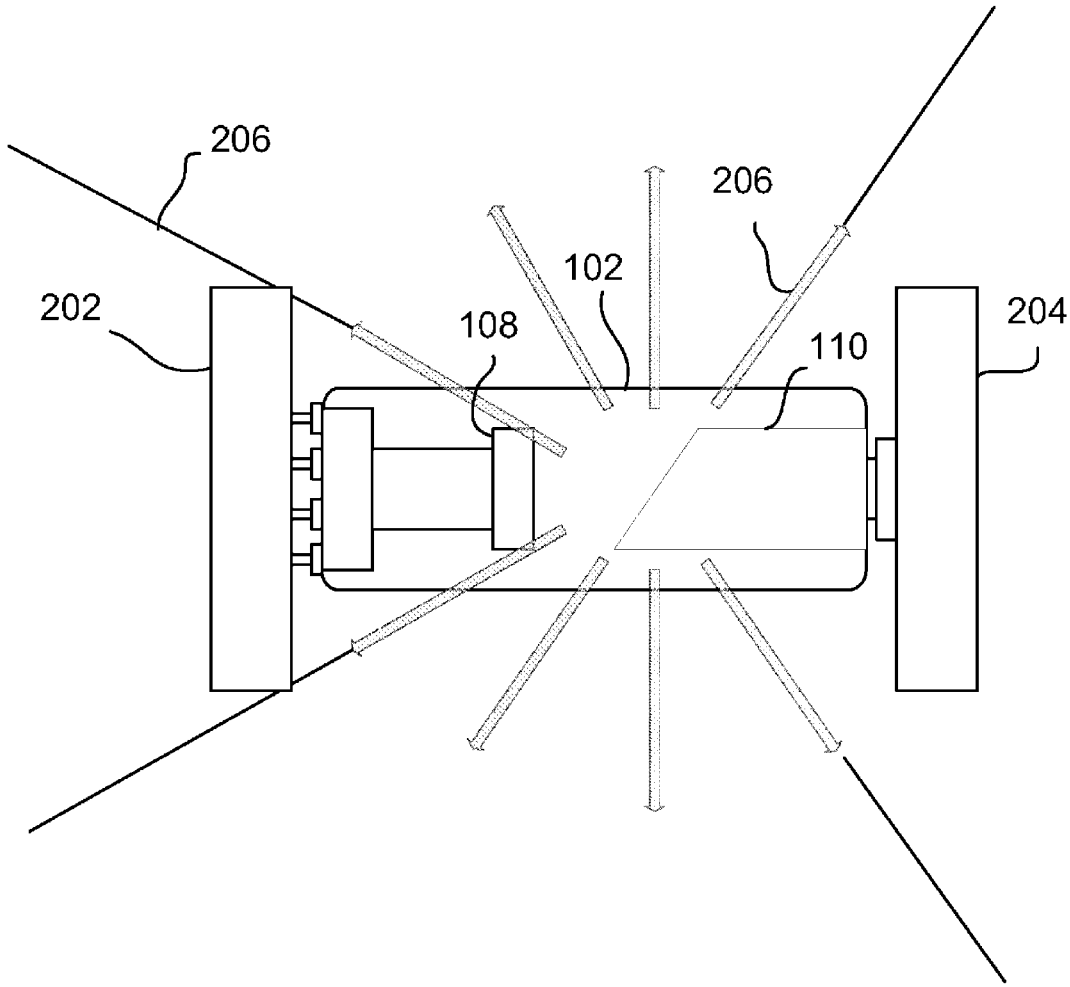
FIG. 2
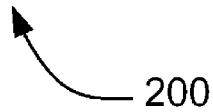

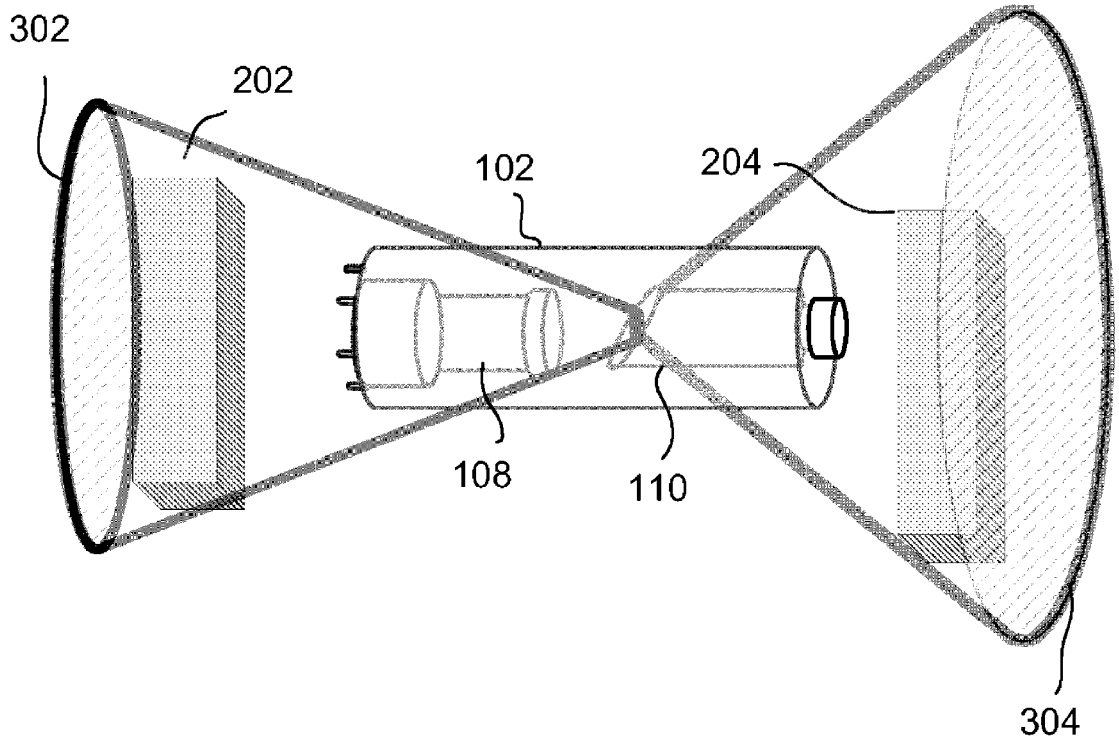
FIG. 3
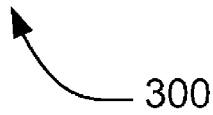

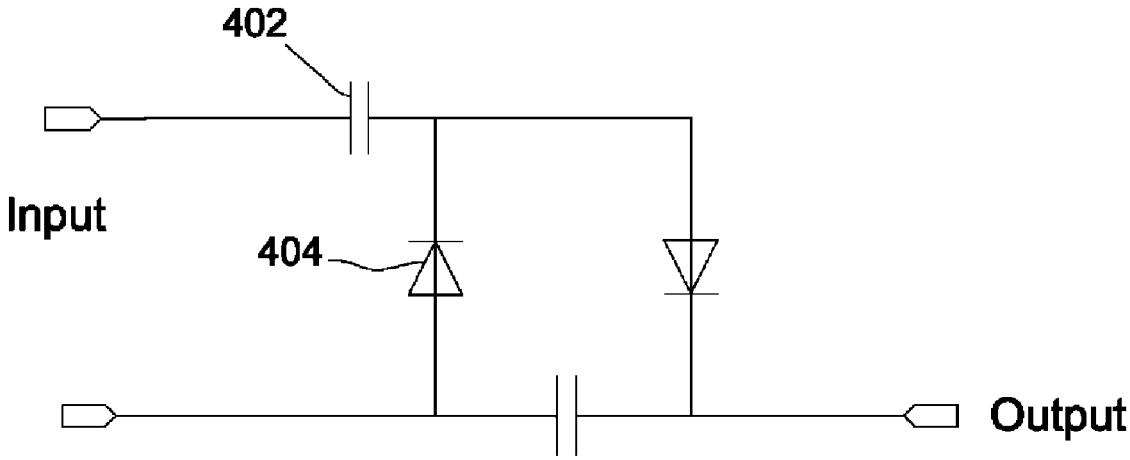
FIG. 4
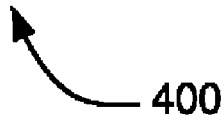

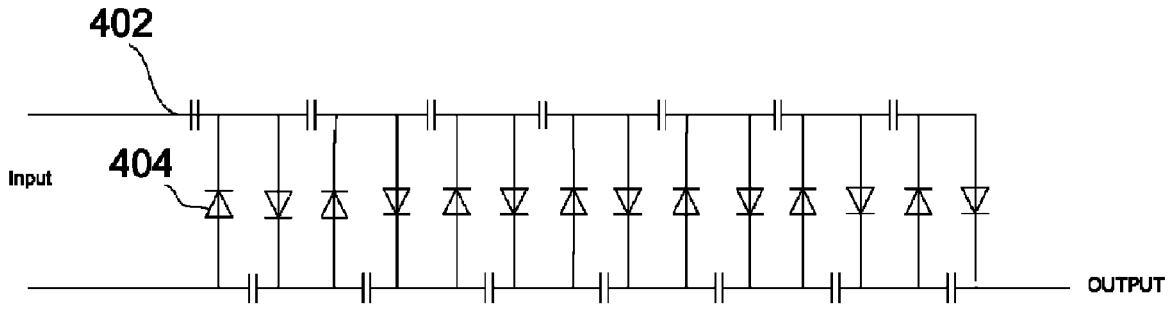
FIG. 5
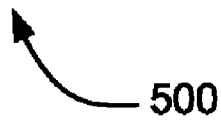

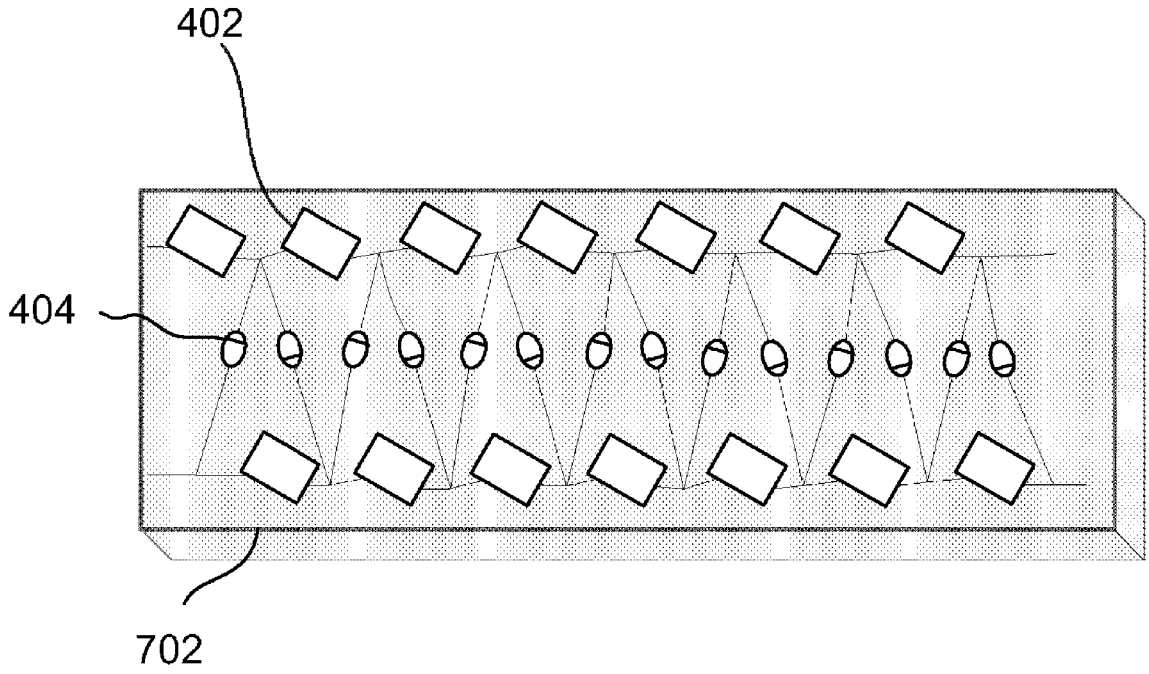
FIG. 7
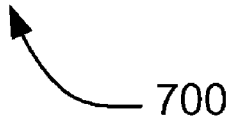

SYSTEMS AND APPARATUS FOR A COMPACT LOW POWER X-RAY GENERATOR

FIELD OF THE INVENTION

The present invention relates generally to X-ray generators and more particularly to compact low power X-ray generators for use in radiographic apparatus for use in the medical and industrial fields to perform non-invasive examinations.

BACKGROUND OF THE INVENTION

An X-ray generator is a valuable tool used in the medical and industrial field to perform non-invasive examinations. To generate X-rays, an X-ray tube and a high voltage power supply are required for operation. The X-ray tube is a vacuum tube which is usually a bipolar device with a cathode and filament at one end of the tube and an anode coated with tungsten at the other end of the tube facing the cathode. To produce X-rays, high voltage power supplies of positive and negative polarity are connected to the X-ray tube's anode and cathode respectively to create an extremely high voltage differential between the anode and the cathode. As current is passed through the filament at the cathode, the filament heats up and sputters off electrons at the cathode. The electrons are then drawn across the tube towards the positively charged anode at great speed and acceleration. When these accelerated electrons bombard the anode surface, energy is released in the form of heat and high-energy photons. These high-energy photons are commonly known as X-ray beams and have been used to perform noninvasive examinations in the medical and industrial fields because of their ability to pass though objects.

All X-ray generators require an extremely high voltage power supply to power the X-ray tube. Commonly, a voltage multiplier and a high frequency transformer are used to create this high voltage for advantage of size.

A popular voltage multiplier configuration commonly used in X-ray systems is known as the Crockroft-Walton configuration. In the Crockroft-Walton circuit, a basic block consisting of two diodes and two capacitors are used to make a voltage multiplier stage. Several stages are stacked together to step up the voltage to significant levels. The output voltage of a multistage voltage multiplier is nominally twice the input voltage times the number of stages. The packaging scheme requires particular attention because the extremely high voltages developed in the voltage multipliers can cause the high voltage to arc over between components and to other structures in close proximity.

The simplest way to stack the multiple stages of a voltage multiplier is to stack the multiplier stages in a straight line. The straight-line multiplier though simple to construct is often not optimal in size. The size of such a straight-line multiplier constrains practical location for the anode and cathode voltage multipliers in an X-ray generator. In a very compact x-ray generator, the preferred option is to place the voltage multipliers parallel to the X-ray tube but this can create other problems as well. When an X-ray tube is operating, X-ray radiation is emitted from the X-ray tube in all directions. This X-ray radiation can degrade non-radiation hardened components in the voltage multiplier. These susceptible components require X-ray shielding to protect them from the harmful radiation to prevent accelerated degradation. This X-ray shield must be placed between the X-ray tube and the multiplier components if the multiplier is placed parallel to the X-ray tube.

A secondary problem created by placing the multiplier components parallel to the X-ray tube concerns insulation between the X-ray tube, multipliers and the X-ray shield causing a complex interaction of the electric fields. When the shield is not used, the electric field created by the high voltage multipliers would interfere with the electric field homogeneity around the X-ray tube when the multiplier components are placed parallel to the X-ray tube. The shield, if used, also restricts efficient heat transfer around the X-ray tube due to high packing density of heat generating components. The use of an X-ray shield can be avoided by using radiation hardened electronic components but the cost of the X-ray generator system would be impacted. The availability of potential components would also be impacted as the selection of radiation-hardened components is limited. The X-ray shield, which is usually made from lead, adds to the size of the design and is inconsistent with the compact nature of the system.

For the reasons stated above, and for the reasons stated below which will become apparent to those skilled in the art upon reading and understanding the present specification, there is a need in the art for a low cost, compact and light-weight low power X-ray generator where the voltage multipliers are reduced in size and use of lead is minimized. There is also a need for a compact low power X-ray generator where the intelligent design of the multipliers facilitate homogeneous distribution of electric field and efficient heat transfer around the X-ray tube.

BRIEF DESCRIPTION OF THE INVENTION

The above-mentioned shortcomings, disadvantages and problems are addressed herein, which will be understood by reading and studying the following specification.

An object of the present invention is to provide a compact low power X-ray generator with a compact design and proper placement of multipliers.

In one aspect, the compact design of the compact low power X-ray generator is accomplished by locating the anode and cathode voltage multipliers in the X-ray shadow zones of the X-ray tube behind the anode and cathode. This eliminates the need for heavy lead shielding which is required to prevent multipliers component degradation caused by the effects of the X-ray radiation.

In another aspect, locating the voltage multipliers behind their respective X-ray tube inputs also reduces field inhomogeneity issues around the X-ray tube.

In yet another aspect, the size of the X-ray tube's voltage multipliers are minimized by utilizing a component placement scheme where the voltage multiplier components and stages are laid out in a zigzag configuration.

In yet another aspect, encapsulating the voltage multiplier components in a non-conductive potting material further reduces the size of the voltage multipliers. By encapsulating the voltage multiplier components in a nonconductive potting material, the voltage multiplier components can be spaced closer together and the possibility for a high voltage arc between the components is eliminated The present compact low power X-ray generator describes systems, methods, and apparatus of varying scope. In addition to the aspects and advantages of the present compact low power X-ray generator described in this summary, further aspects and advantages of the compact low power X-ray generator will become apparent by reference to the drawings and by reading the detailed description that follows.

BRIEF DESCRIPTION OF THE DRAWINGS

For the purpose of illustrating the invention, several forms are shown in the drawings which are presently preferred, it being understood, however, that the invention is not limited to the precise arrangement and instrumentalities.

FIG. 2 is a sectional view taken along line A-A in FIG. 1 and showing the X-ray radiation emissions during normal operation of the X-ray tube;

FIG. 3 is a perspective view a compact low power X-ray generator further showing conical X-ray shadow zones located directly behind the X-ray tube anode and cathode;

FIG. 4 is a schematic view of a single stage anode voltage multiplier

FIG. 5 is a schematic view of a multiple stage voltage multiplier. The voltage multiplier depicted in FIG. 5 depicts a seven-stage anode multiplier.

FIG. 7 is a perspective view of voltage multiplier with a plurality of stages using a conventional straight-line voltage multiplier.

DETAILED DESCRIPTION OF THE INVENTION

In the following detailed description of embodiments of the compact low power X-ray generator, reference is made to the accompanying drawings that form a part hereof, and in which is shown by way of illustration specific embodiments in which the compact low power X-ray generator may be practiced. These embodiments are described in sufficient detail to enable those skilled in the art to practice the compact low power X-ray generator, and it is to be understood that other embodiments may be utilized and that logical, mechanical, electrical and other changes may be made without departing from the scope of the present compact low power X-ray generator. The following detailed description is, therefore, not to be taken in a limiting sense.

The detailed description is divided into three sections. In the first section, a system level overview is described. In the second section, apparatus of embodiments are described. Finally, in the third section, a conclusion of the detailed description is provided.

System Level Overview

Figure 1:
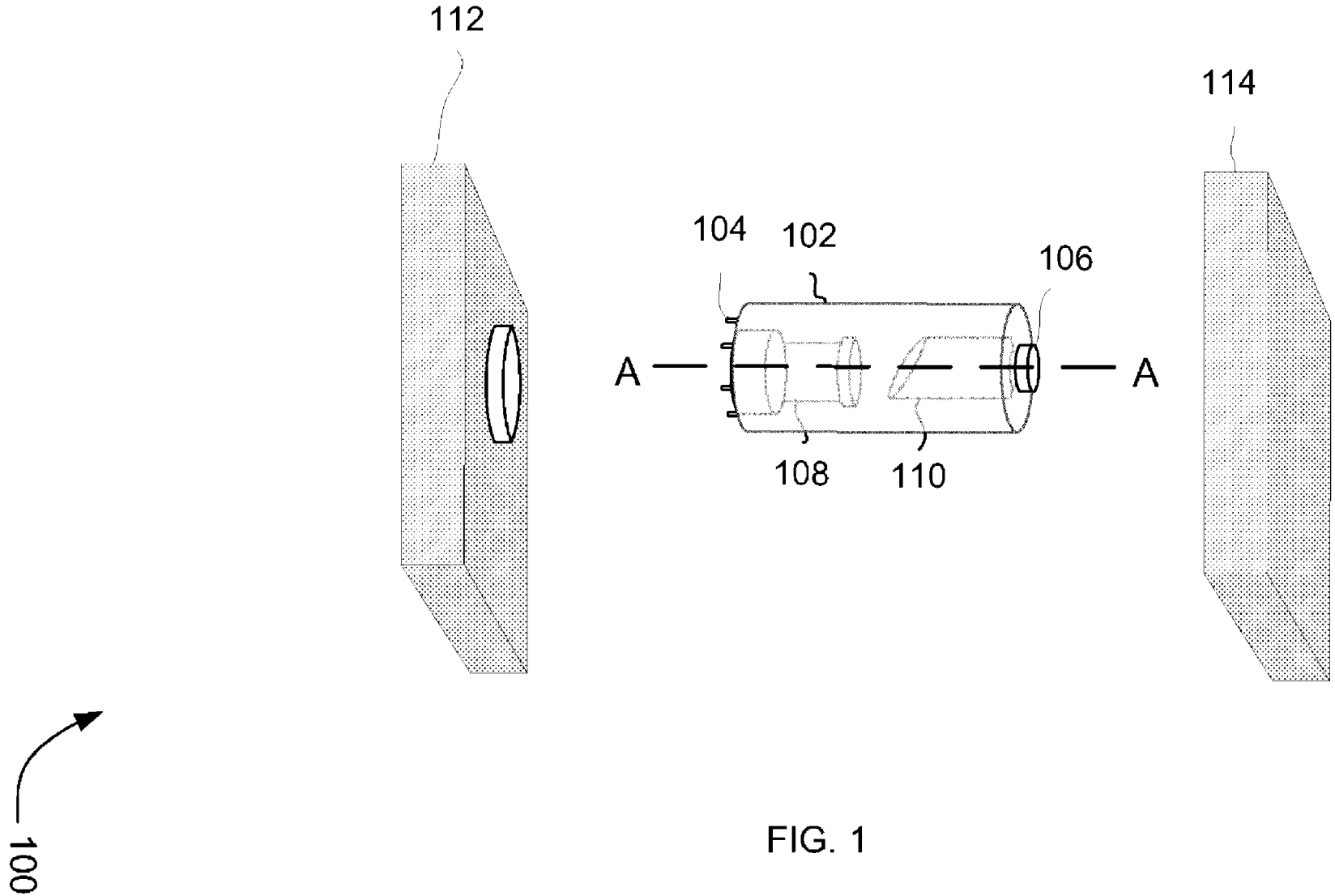
FIG. 1 is a perspective view of a compact low power X-ray generator that is the object of this invention.

FIG. 1 is system level overview of a compact low power X-ray generator. The compact low power X-ray generator solves the need in the art for a compact X-ray generator, which does not require heavy thick lead or copper shielding to shield the X-ray tube's power supplies from the X-ray radiation produced by the X-ray tube.

The compact low power X-ray generator generally consists of a cylindrical bipolar X-ray tube 102 containing an cathode and an anode at opposite ends of the X-ray tube with a cathode power supply 112 located directly behind the tube's cathode 108 and an anode power supply 114 located directly behind the anode 110.

When the X-ray tube 102 is powered up with suitable filament supply in the cathode, electrons are sputtered off the heated cathode 108 and accelerate towards the positively charged anode 110. The electrons are drawn across the X-ray tube 102 and collide with the anode 110 with great force producing X-ray radiation 206.

The X-ray radiation produced by the collision is emitted in all directions. In the compact low power X-ray generator, the X-ray tube's own cathode 108 and anode 110 are capable to shield low power X-rays directly behind the electrodes as they produce conical shadow areas. These conical shadow areas are located directly behind both the cathode and the anode.

By locating the cathode voltage multiplier 202 and the anode voltage multiplier 204 in the shadow zones created by the X-ray tube's cathode 108 and anode 110, the compact low power X-ray generator solves the need in the art for heavy lead or copper shielding to prevent X-ray radiation degradation of the voltage multiplier components.

While the compact low power X-ray generator is not limited to any particular voltage multiplier location, for sake of clarity a simplified voltage multiplier location is described.

APPARATUS EMBODIMENTS

In the previous section, a system level overview of the operation of an embodiment was described. In this section, the particular apparatus of such an embodiment are described by reference to a series of diagrams.

FIG. 2 is a sectional view of the compact low power X-ray generator according to one embodiment. The compact low power X-ray generator solves the need in the art for a compact design by eliminating the requirement for heavy lead or copper shielding to protect the cathode voltage multiplier 202 and the anode voltage multiplier 204 from the X-ray radiation 206 emitted from the X-ray tube 102 when the X-ray tube 102 is operating.

The compact low power X-ray generator includes the bipolar X-ray tube 102, which contains a cathode 108 and an anode 110, a cathode voltage multiplier 202 and an anode voltage multiplier 204.

During operation of the X-ray tube, X-ray radiation 206 is emitted from the X-ray tube 102 in all directions. The radiation will penetrate objects and can degrade certain semiconductor components unless the components are shielded from the radiation.

FIG. 3 shows a conical shadow zone 302 located behind the X-ray tube's cathode 108 that is free from the X-ray radiation produced by the X-ray tube 102. The X-ray tube's cathode 108 acts as a shield to block X-ray radiation in the axial direction directly behind the X-ray tube's cathode 108. By locating the cathode voltage multiplier 202 in this conical shadow zone 302, a heavy lead or copper shield is not required to protect the power supply components from degradation caused by the X-ray radiation.

FIG. 3, also shows a conical shadow zone 304 located behind the X-ray tube's anode 110 that is also free from X-ray radiation. The X-ray tube's anode 110 acts as a shield and produces a conical shadow zone 304 behind the X-ray tube's anode 110 in which the anode voltage multiplier 204 may be located.

FIG. 4 shows an embodiment of a single stage anode voltage power supply that may used to produce the high voltage necessary to operate the X-ray tube. The single stage is a commonly used Cockroft-Walton voltage multiplier. Each stage of the Cockroft-Walton voltage multiplier is made up of two capacitors 402 and two diodes 404.

FIG. 5 shows a seven-stage multiplier that can be used to increase a relatively low voltage to the high voltage necessary to operate the X-ray tube. Multiple stages are a series of single stage voltage multipliers strung together to increase the input voltage to the required operating voltage for the X-ray tube. A multiple stage voltage multiplier contains only capacitors 402 and diodes 404 to increase the voltage. A similar style voltage multiplier with negative polarity may be used to power the X-ray tube's cathode. With the negatively charge cathode and the positively charged anode, the power supplies create the large voltage differential required to accelerate the sputtered electrons from the cathode to produce X-rays when the electrons collide with the X-ray tube's anode.

Figure 6:
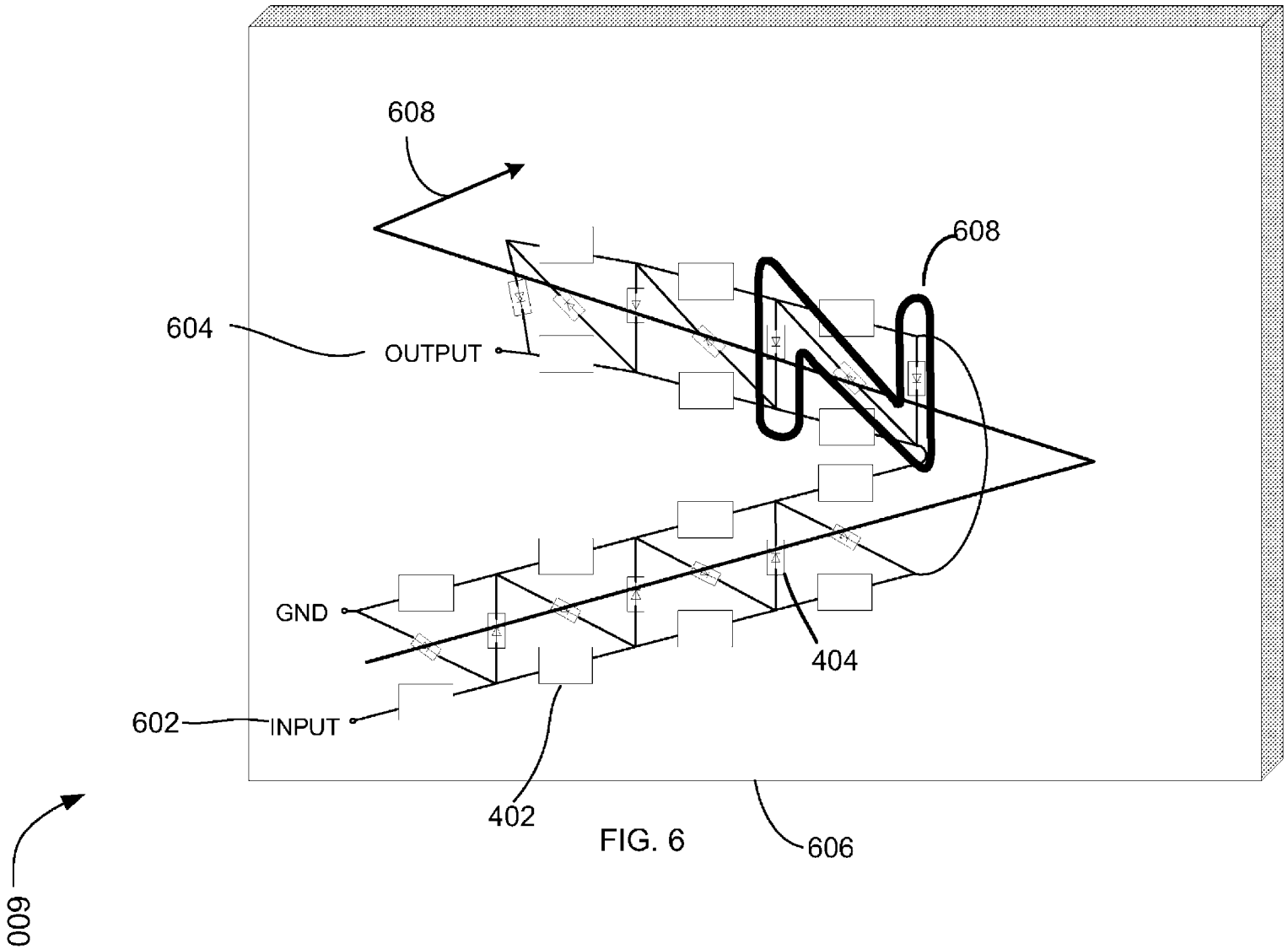
FIG. 6 is a perspective view of a voltage multiplier with a plurality of stages using a zigzag configuration.

FIG. 6 shows an embodiment of a multiple stage voltage multiplier that is laid out in a zigzag configuration 608. An input voltage 602 is applied to the input stage capacitor 402 and diode 404 pair and each subsequent capacitor and diode is connected to the input stage in a zigzag fashion to keep the distance between the components as great as possible to prevent the high voltage from arcing. The output voltage 604 is increased significantly using the multiple stage voltage multiplier. Each stage of the voltage multiplier is laid out in a zigzag layout on the voltage multiplier PWB 606 to minimize the size of the voltage multiplier. The zigzag configuration allows the voltage multiplier size to be reduced significantly which allows the voltage multiplier to fit in the shadow zones created by the X-ray tube's cathode and anode.

The zigzag arrangement of the multiplier components and stages where the voltage is built up at the input 602 and gradually increases to the height of the tube contributes to the creation of homogenous electric fields around the X-ray tube. This is particularly important for the insulating bracket used for mounting of the X-ray tube.

In comparison, FIG. 7 shows a multiple stage voltage multiplier that is laid out in a traditional straight-line configuration. The straight-line voltage multiplier layout also uses a pairs of capacitors 402 and diodes 404 for each multiplier stage but the length of the voltage multiplier PWB 702 must be extended to accommodate the multiple stages. This straight line voltage multiplier does not meet the needs of a compact low power X-ray generator because its lengthy PWB 702 would extend outside the boundary of the X-ray shadow zone if the voltage multiplier were mounted directly to the X-ray tube's cathode or anode input connection. In order to protect the semiconductor components which would be subjected to the harmful X-ray radiation, a heavy lead or copper shield would be required which adds to the size of the system and is inconsistent with the compact nature of the a compact design.

CONCLUSION

A compact low power X-ray generator is described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations. For example, although the power supplies are described as voltage multipliers, one of ordinary skill in the art will appreciate that implementations can be made by using power converters or any other types of voltage increasers that provides the required function.

In particular, one of skill in the art will readily appreciate that the names of the methods and apparatus are not intended to limit embodiments. Furthermore, additional methods and apparatus can be added to the components, functions can be rearranged among the components, and new components to correspond to future enhancements and physical devices used in embodiments can be introduced without departing from the scope of embodiments.

I claim:

1. An apparatus comprising:

an X-ray tube having a cylindrical tube comprising:

an anode located at one end of the X-ray tube to generate X-ray radiation;

a cathode located at an opposite end of the X-ray tube to excite the anode so as to generate the X-ray radiation and to provide a cathode conical shadow area that is free of the generated X-ray radiation; and at least one cathode power supply located within the cathode conical shadow area;

wherein the cathode power supply is shielded from the X-ray radiation by the cathode.

2. The apparatus of claim 1, wherein the cathode power supply further comprises:

a multiple stage cathode voltage multiplier.

3. The apparatus of claim 2, wherein each stage further comprises at least one capacitor and at least one diode.

4. The apparatus of claim 3, wherein the stages further comprises a zigzag configuration.

5. The apparatus of claim 2, wherein the multiple stage cathode voltage multiplier further comprises a seven-stage cathode voltage multiplier.

6. An apparatus comprising:

an X-ray tube having a cylindrical tube comprising:

an anode located at one end of the X-ray tube to generate X-ray radiation and to provide an anode conical shadow area that is free of the generated X-ray radiation;

a cathode located at an opposite end of the X-ray tube to excite the anode so as to generate the X-ray radiation; and at least one anode power supply located within the anode conical shadow area;

wherein the anode power supply is shielded from the X-ray radiation by the anode.

7. The apparatus of claim 6, wherein the anode power supply further comprises:

a multiple stage anode voltage multiplier.

8. The apparatus of claim 7, wherein each stage further comprises:

at least one capacitor and at least one diode.

9. The apparatus of claim 8, wherein the capacitors and diodes further comprises a zigzag configuration.

10. The apparatus of claim 7, wherein the multiple stage cathode voltage multiplier further comprises a seven-stage cathode voltage multiplier.

11. An apparatus comprising:

an X-ray tube having a cylindrical tube comprising:

an anode located at one end of the X-ray tube to generate X-ray radiation and to provide an anode conical shadow area that is free of the generated X-ray radiation;

a cathode located at an opposite end of the X-ray tube to excite the anode so as to generate the X-ray radiation and to provide a cathode conical shadow area that is free of the generated X-ray radiation;

at least one anode power supply located within the anode conical shadow area, wherein the anode power supply is shielded from the X-ray radiation by the anode; and at least one cathode power supply located within the cathode conical shadow area;

wherein the cathode power supply is shielded from the X-ray radiation by the cathode.

12. The apparatus of claim 11 wherein the anode power supply further comprises:

a multiple stage anode voltage multiplier.

13. The apparatus of claim 12, wherein each stage further comprises:

at least one capacitor and one diode.

14. The apparatus of claim 13, wherein the capacitors and diodes further comprises a zigzag configuration.

15. The apparatus of claim 11, wherein the cathode power supply further comprises:

a multiple stage cathode voltage multiplier.

16. The apparatus of claim 15, wherein each stage further comprises:

at least one capacitor and one diode.

17. The apparatus of claim 15, wherein the capacitors and diodes further comprises a zigzag configuration.

18. The apparatus of claim 12, wherein the multiple stage cathode voltage multiplier further comprises a seven-stage cathode voltage multiplier.

19. The apparatus of claim 15, wherein the multiple stage cathode voltage multiplier further comprises a seven-stage cathode voltage multiplier.

20. An apparatus for a compact low power X-ray generator, the apparatus comprising:

an X-ray tube having a cylindrical tube comprising:

an anode located at one end of the X-ray tube to generate X-ray radiation and to provide an anode conical shadow area that is free of the generated X-ray radiation;

a cathode located at an opposite end of the X-ray tube to excite the anode so as to generate the X-ray radiation and to provide a cathode conical shadow area that is free of the generated X-ray radiation;

at least one anode power supply located within the anode conical shadow area, wherein the anode power supply is shielded from the X-ray radiation by the anode; and at least one cathode power supply located within the cathode conical shadow area;

wherein the cathode power supply is shielded from the X-ray radiation by the cathode.

* * * * *